US010974095B2

(12) United States Patent
Howett et al.

(10) Patent No.: US 10,974,095 B2
(45) Date of Patent: Apr. 13, 2021

(54) EXERCISE APPARATUS

(71) Applicants: Robert Victor Howett, Berkshire (GB); Raymond Lewis McCallum, London (GB)

(72) Inventors: Robert Victor Howett, Berkshire (GB); Raymond Lewis McCallum, London (GB)

( * ) Notice: Subject to any disclaimer, the term of this patent is extended or adjusted under 35 U.S.C. 154(b) by 0 days.

(21) Appl. No.: 16/084,747

(22) PCT Filed: Mar. 14, 2017

(86) PCT No.: PCT/GB2017/050693
§ 371 (c)(1),
(2) Date: Sep. 13, 2018

(87) PCT Pub. No.: WO2017/158342
PCT Pub. Date: Sep. 21, 2017

(65) Prior Publication Data

US 2019/0070457 A1 Mar. 7, 2019

(30) Foreign Application Priority Data

Mar. 16, 2016 (GB) ..... 1604465.3

(51) Int. Cl.
*A63B 22/06* (2006.01)
*A63B 21/22* (2006.01)
(Continued)

(52) U.S. Cl.
CPC .... *A63B 22/0664* (2013.01); *A63B 21/00069* (2013.01); *A63B 21/0084* (2013.01);
(Continued)

(58) Field of Classification Search
CPC ..... A63B 21/00058; A63B 21/00069; A63B 21/00072; A63B 21/00076;
(Continued)

(56) References Cited

U.S. PATENT DOCUMENTS 5,044,627 A 9/1991 Huang
5,580,338 A * 12/1996 Scelta ..... A63B 22/0002 482/114
(Continued)

FOREIGN PATENT DOCUMENTS

DE 102011055202 3/2013
EP 0323023 7/1989
(Continued)

*Primary Examiner* — Gary D Urbiel Goldner
(74) *Attorney, Agent, or Firm* — Vedder Price P.C.

(57) ABSTRACT

An exercise apparatus (10) has two wheels (12, 12') rotatably mounted to a base (14, 14'), spaced apart and each located within a pair of wheel housings (15, 15'), respectively. Pivotably connected to each wheel is a cam (16). Another end of the cam (16) is pivotably connected to a push rod (17) which is pivotably connected to a handle (18) which is rotatably mounted in a housing (20). The pair of handle housings (20) are pivotably and respectively mounted to the pair of cams (16) such that movement of each arm in a vertical plane up or down by operating on the respective handle causes an elliptical rotation of the respective cam relative to the respective wheel (12, 12').

17 Claims, 9 Drawing Sheets

(51) Int. Cl.

| | |
|---|---|
| ***A63B 22/00*** | (2006.01) |
| ***A63B 23/035*** | (2006.01) |
| ***A63B 21/00*** | (2006.01) |
| ***A63B 21/008*** | (2006.01) |
| ***A63B 21/045*** | (2006.01) |
| ***A63B 71/00*** | (2006.01) |

(52) U.S. Cl.

CPC .... *A63B 21/0088* (2013.01); *A63B 21/00192* (2013.01); *A63B 21/045* (2013.01); *A63B 21/225* (2013.01); *A63B 21/4035* (2015.10); *A63B 21/4049* (2015.10); *A63B 22/0002* (2013.01); *A63B 22/0005* (2015.10); *A63B 22/0048* (2013.01); *A63B 23/03541* (2013.01); *A63B 2022/0051* (2013.01); *A63B 2022/0682* (2013.01); *A63B 2071/0018* (2013.01); *A63B 2208/0228* (2013.01); *A63B 2225/09* (2013.01); *A63B 2225/093* (2013.01)

(58) Field of Classification Search

CPC ..... A63B 21/00192; A63B 21/0051; A63B 21/0052; A63B 21/0056; A63B 21/0057; A63B 21/008; A63B 21/0083; A63B 21/0084; A63B 21/00845; A63B 21/0085; A63B 21/0087; A63B 21/0088; A63B 21/012; A63B 21/0125; A63B 21/015; A63B 21/018; A63B 21/02; A63B 21/022; A63B 21/023; A63B 21/04; A63B 21/047; A63B 21/0414; A63B 21/0421; A63B 21/0428; A63B 21/0442; A63B 21/045; A63B 21/0455; A63B 21/0601; A63B 21/0602; A63B 21/0606; A63B 21/15; A63B 21/158; A63B 21/159; A63B 21/22; A63B 21/225; A63B 21/4027; A63B 21/4029; A63B 21/4031; A63B 21/4033; A63B 21/4035; A63B 21/4041; A63B 21/4045; A63B 21/4047; A63B 21/4049; A63B 22/0002; A63B 22/0005; A63B 22/0015; A63B 22/0017; A63B 22/0046; A63B 22/0048; A63B 22/0056; A63B 22/06; A63B 22/0664; A63B 22/0694; A63B 2022/0051; A63B 2022/0682; A63B 23/035; A63B 23/03508; A63B 23/03516; A63B 23/03533; A63B 23/03541; A63B 23/12; A63B 23/1209; A63B 23/1245; A63B 23/1263; A63B 23/1281; A63B 71/0009; A63B 71/0054; A63B 2071/0018; A63B 2071/0063; A63B 2071/0072; A63B 2071/0081; A63B 2071/009; A63B 2208/0228; A63B 2208/0233; A63B 2225/09; A63B 2225/093

See application file for complete search history.

(56) References Cited

U.S. PATENT DOCUMENTS

| | | | | |
|---|---|---|---|---|
| 5,836,855 | A * | 11/1998 | Eschenbach | A63B 22/001 482/57 |
| 5,957,814 | A * | 9/1999 | Eschenbach | A63B 22/001 482/51 |
| 6,017,294 | A * | 1/2000 | Eschenbach | A63B 22/001 482/51 |
| 6,749,544 | B1 * | 6/2004 | Chen | A63B 21/00069 482/57 |
| 6,811,517 | B1 * | 11/2004 | Eschenbach | A63B 22/001 482/52 |
| 7,993,247 | B1 * | 8/2011 | Eschenbach | A63B 22/001 482/51 |
| 8,113,995 | B1 * | 2/2012 | Hsu | A63B 22/001 482/51 |
| 9,144,706 | B1 * | 9/2015 | Maresh | A63B 22/04 |
| 9,339,685 | B1 * | 5/2016 | Maresh | A63B 22/04 |
| 9,415,259 | B2 * | 8/2016 | Ramdas | A63B 21/225 |
| 9,492,700 | B1 * | 11/2016 | Wu | A63B 21/015 |
| 2001/0031685 | A1 * | 10/2001 | Maresh | A63B 22/001 482/51 |
| 2004/0102291 | A1 * | 5/2004 | Eschenbach | A63B 21/00178 482/52 |
| 2004/0235621 | A1 * | 11/2004 | Eschenbach | A63B 22/001 482/52 |
| 2005/0043152 | A1 * | 2/2005 | Krietzman | A63B 21/0603 482/115 |
| 2005/0043153 | A1 * | 2/2005 | Krietzman | A63B 21/0603 482/115 |
| 2005/0143227 | A1 * | 6/2005 | Krietzman | A63B 22/0002 482/92 |
| 2005/0187076 | A1 * | 8/2005 | Mason | A63B 23/12 482/93 |
| 2008/0220947 | A1 * | 9/2008 | Meng | B62M 1/24 482/62 |
| 2008/0312052 | A1 * | 12/2008 | Krietzman | A63B 21/0051 482/92 |
| 2010/0204017 | A1 * | 8/2010 | Uffelman | A63B 22/001 482/52 |
| 2012/0258840 | A1 * | 10/2012 | Eisenberg | A63B 22/001 482/57 |
| 2014/0243159 | A1 * | 8/2014 | Oblak | A63B 22/001 482/57 |
| 2015/0246260 | A1 * | 9/2015 | Giannelli | A63B 23/0476 482/8 |
| 2016/0243398 | A1 * | 8/2016 | McInelly | A63B 22/0664 |
| 2016/0243399 | A1 * | 8/2016 | McInelly | A63B 22/0664 |
| 2016/0243400 | A1 * | 8/2016 | Dalebout | A63B 22/0664 |
| 2016/0375300 | A1 * | 12/2016 | Chang | A63B 22/0664 482/52 |

FOREIGN PATENT DOCUMENTS

| | | |
|---|---|---|
| EP | 2383020 | 11/2011 |
| WO | 03013661 | 2/2003 |
| WO | 2012105902 | 8/2012 |

* cited by examiner

EXERCISE APPARATUS

The present invention relates to exercise apparatus. More particularly, the present invention relates to exercise apparatus operated by hand.

Numerous machines have been devised to strengthen and condition leg muscles or arm muscles in gymnasia or home use. These machines benefit from being capable of being located indoors out of the elements avoiding adverse weather conditions and have a relatively small footprint, advantageous when restrictions on space prohibit many people from being able to conveniently participate in sport, running, walking etc.

Such machines might include, treadmills, stepping machines and elliptical exercise machines which benefit users by helping them to improve their cardiovascular fitness and/or reduce weight. These machines are considered to have a 'low impact' on a person's body as the motion is relatively gentle on the joints and the impact to the body is limited in different ways depending upon the type of machine being used. Consequently, these machines are often considered the best choice for older people, individuals recovering from injury or having a physical impairment.

There are numerous elliptical trainers, such as, U.S. Pat. No. 6,726,600 which describes a compact elliptical exercise device that simulate walking and jogging with arm exercise. However, such machines are unsuitable for wheel chair users, for example, or those having little or no lower limb mobility.

In accordance with a first aspect of the present invention, there is provided an exercise apparatus comprising at least one wheel, at least one bar pivotably connected to the wheel at one end and pivotably connected at the other end to an actuating member, wherein the actuating member is pivotably mounted and comprises a handle mounted thereto such that movement of the handle is possible whilst the at least one bar is displaced during use, and wherein rotation-opposing means is associated with the wheel to provide variable resistance to the rotation of the wheel and wherein the movement of the bar relative to the wheel is elliptical.

The apparatus is beneficial for improving cardiovascular fitness and muscular endurance.

The wheel may be magnetic and the rotation-opposing means comprise at least one magnet.

The rotation-opposing means may comprise any one or more of the following: a torsion spring whose resistance can be varied; at least one magnet; one or more resistance bands; an alternator.

The rotation-opposing means may comprise webbing which can extend at least partially around the circumference of the wheel to provide resistance to the rotation of the wheel.

The rotation-opposing means may comprise one or more blades mountable onto the surface of the wheel to resist rotation by providing resistance against a fluid.

The fluid may comprise any one or more of the following: air, liquid or the like.

The rotation-opposing means may comprise means for varying the resistance to rotation.

The exercise apparatus may be a hand-operated elliptical trainer.

The apparatus may comprise two wheels. The wheels may be spaced apart and may operate independently of one another.

The wheels may be mounted on a frame to enable the distance between the wheels to be varied.

The frame may comprise a sliding track and the wheel housings slidably mounted thereon such that their position with respect to one another can be carried.

The apparatus may be used in any suitable orientation. The apparatus may be moveably mounted on a frame to permit the orientation of the handles to be varied according to the position of a user to vary the exercise. The movement of the handles relative to the wheel may be varied to exercise different muscle groups or place emphasis on different muscles during use.

The apparatus may comprise a braking mechanism to enable an operator to slow or arrest the rotation of the wheel. The braking mechanism may be controlled by an actuator. The actuator may be disposed on a handle.

The apparatus may comprise means for controlling the level of resistance to rotation of the wheel by the rotation-opposing means. The means for controlling the level of resistance may be provided in a handle.

The rotation-opposing means may be operatively connected to the handle by a pulley system.

The present invention will now be described, by way of example only, with reference to the accompanying drawings in which:

FIG. 1 shows an apparatus in accordance with the present invention;

FIGS. 2*a* and *b* show a device and a handle in accordance with the present invention;

FIGS. 3*a* and *b* and 4*a* and *b* show an alternative embodiment having differing handle orientations in accordance with the present invention;

FIGS. 5*a* and *b* show an alternative embodiment having differing handle orientations in accordance with the present invention;

Figure 1:
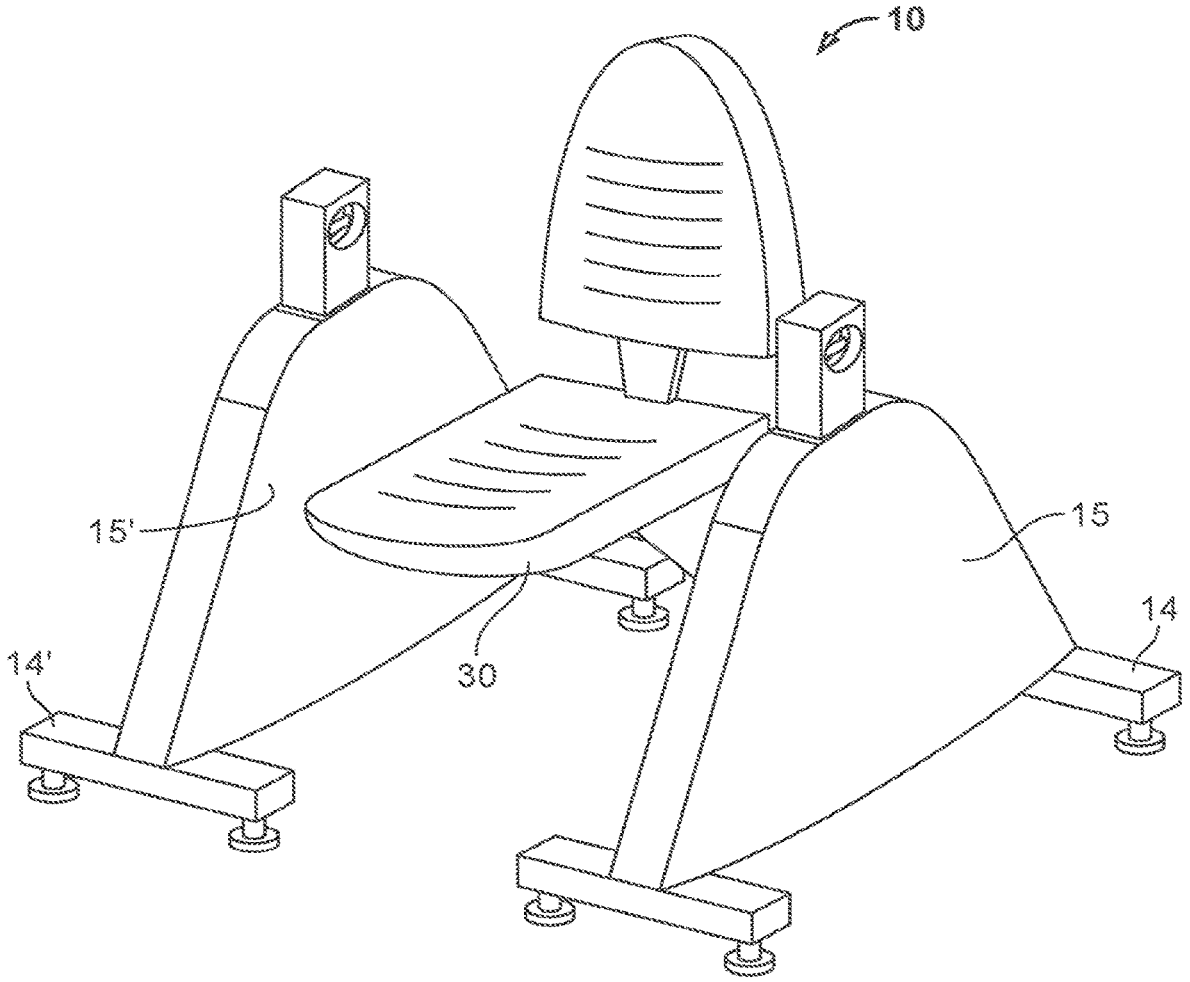
Figure 2A:
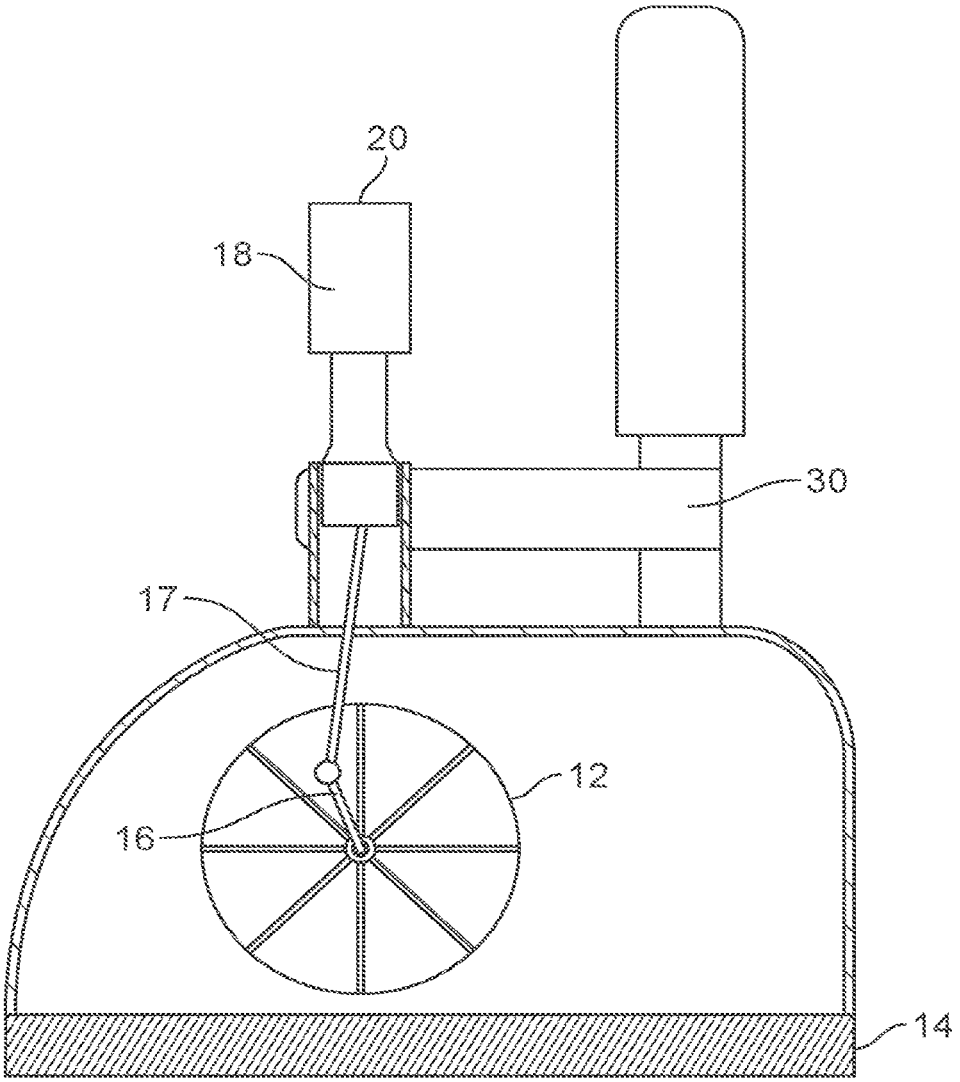
Figure 2B:
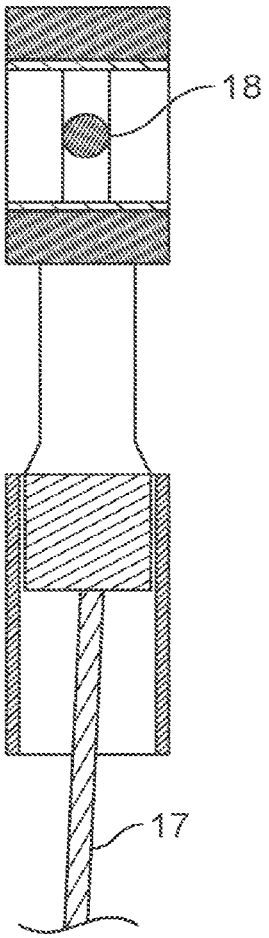

The exercise apparatus 10 has two wheels 12, 12' rotatably mounted to a base 14, 14', spaced apart and each located within a housing 15, 15' respectively. Pivotably connected to the wheel is a cam 16. The other end of cam 16 is pivotably connected to a push rod 17 which is pivotably connected to a handle 18 which is rotatably mounted in a housing 20. Housing 20 is pivotably mounted to the arm 16 such that movement of the arm in a vertical plane up or down by operating on the handle causes an elliptical rotation of the arm relative to the wheel 12.

Disposed between the wheels 12, 12' is a seat 30 for supporting a user's body. The seat is adjustable in its sagittal and transverse plane so that a user may adjust the seat height for optimal position of their hands relative to the body. The adjustment member for height as well as forward or rearward movement comprise a bolt which is biased into an engaged configuration and a shaft having a plurality of apertures each shaped to receive the bolt to lock the position of the seat in either the transverse or sagittal plane.

In an embodiment, the adjustment member may comprise the use of a hydraulic jack. The vertical height can be adjusted electronically or by hand via operating lever.

The handles may comprise grip elements to minimizing the slippage and lift-off of the user's hands to maximize the effectiveness of the exercise.

The wheel may be rotated clockwise or counter clockwise, alternatively rearwardly or forwardly respectively relative to the base. Generally, during a downward power stroke on the elliptical exercise machine 14, the user's hand is pushed down against the elliptical exercise machine's resistance and returned upward with minimal to no resistance. Conversely, during an upward power stroke, the user's hand is pushed upward and returned forward with minimal to no resistance. In the downward power stroke, the primary eccentric muscles of the arm and the abdominals are employed and the concentric muscles are relaxed. In the upward power stroke, the concentric muscles of the arm and the abdominals are employed and the eccentric muscles relaxed.

The apparatus also allows active participation of both eccentric and concentric muscle groups in each downward power stroke and upward power stroke. This is provided by the rotation-opposing means which consists of the magnetic wheel in co-operation with a pair of magnets (not shown) whose resistive effect on the rotation of the wheel can be varied.

Figure 3A:
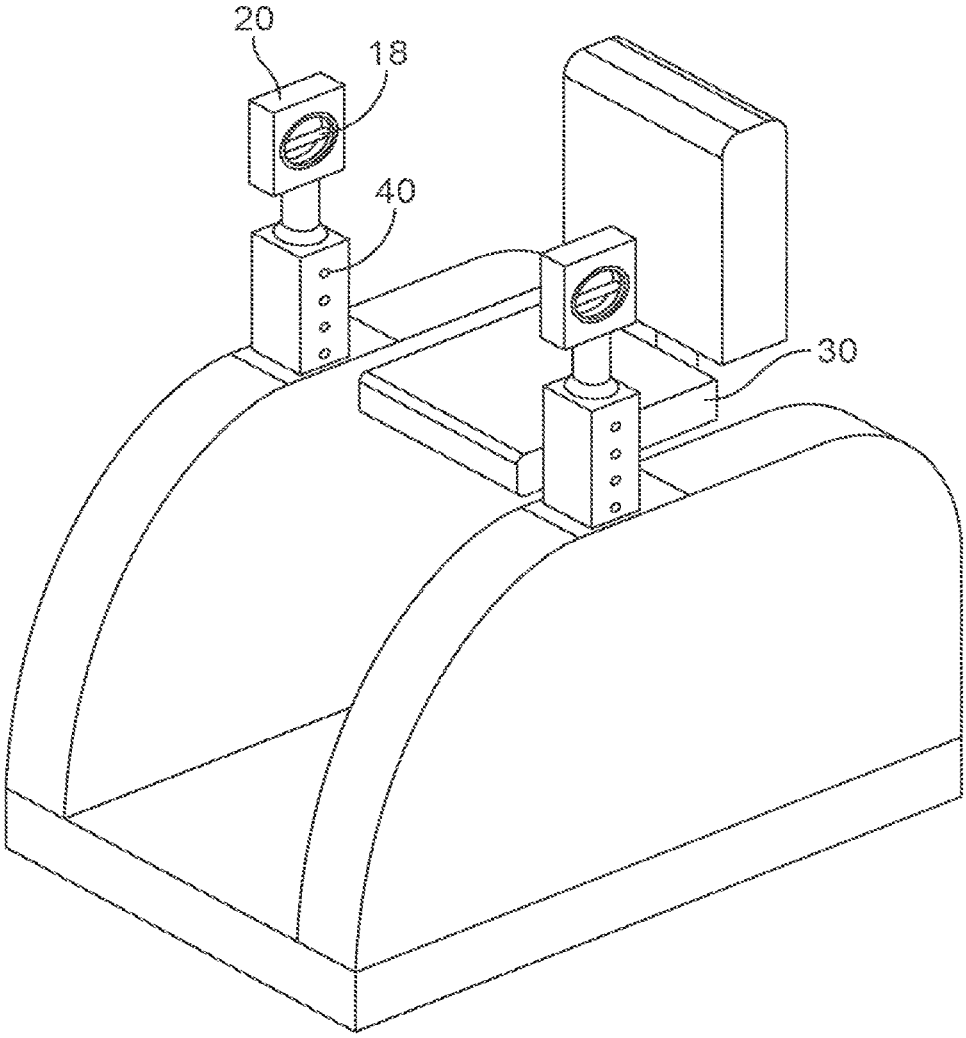
Figure 3B:
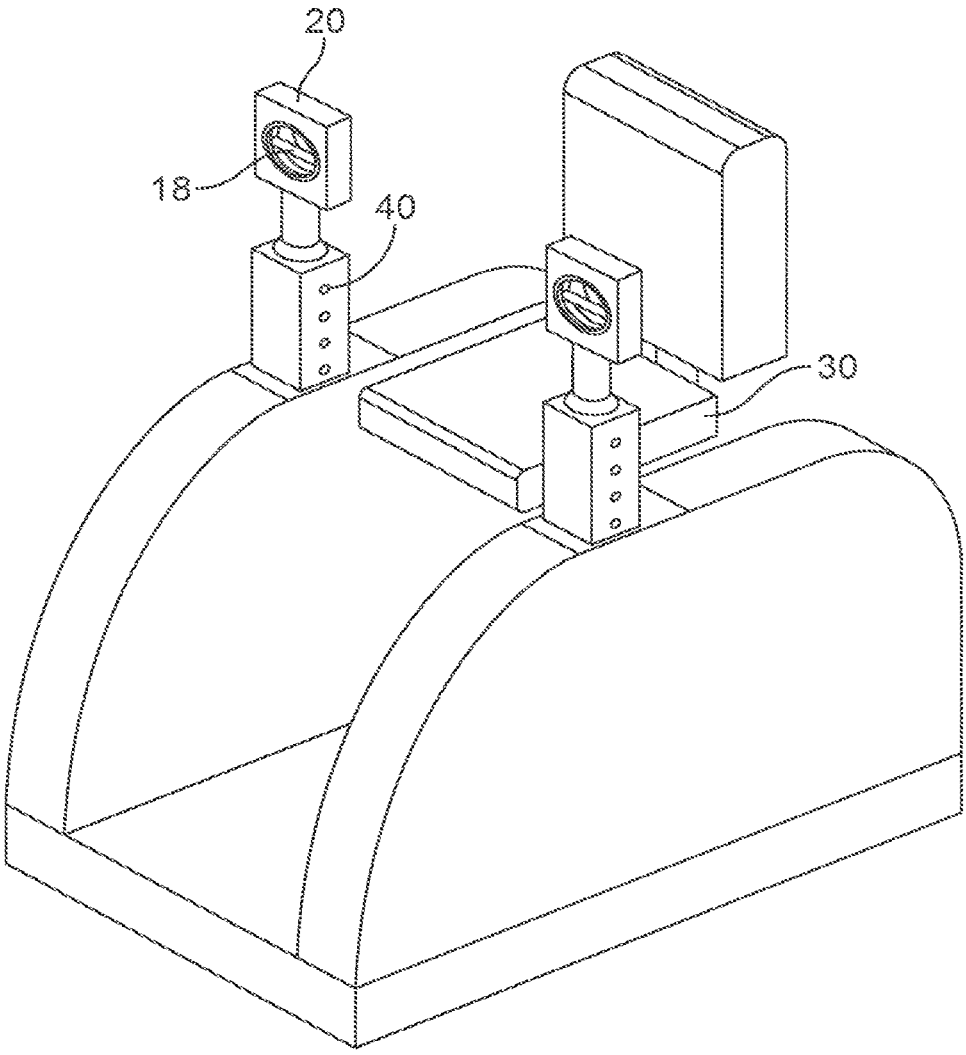
Figure 4A:
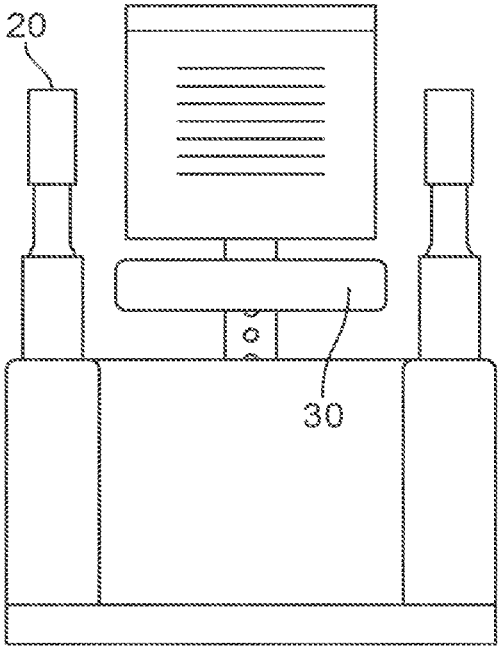
Figure 4B:
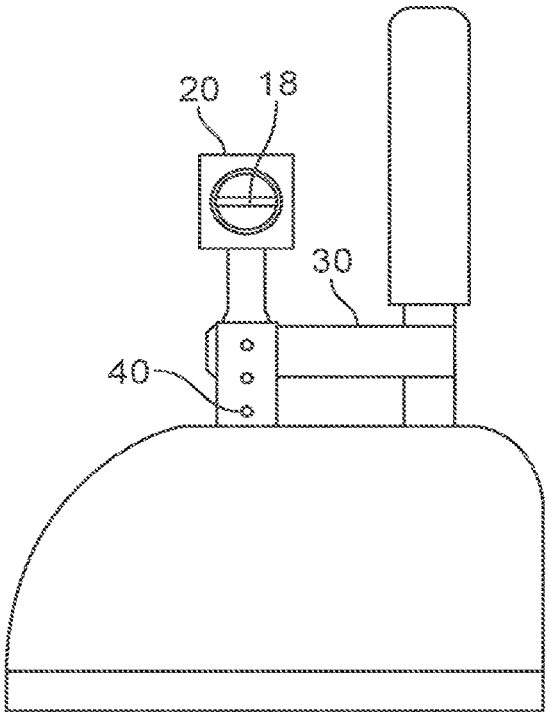
Figure 5A:
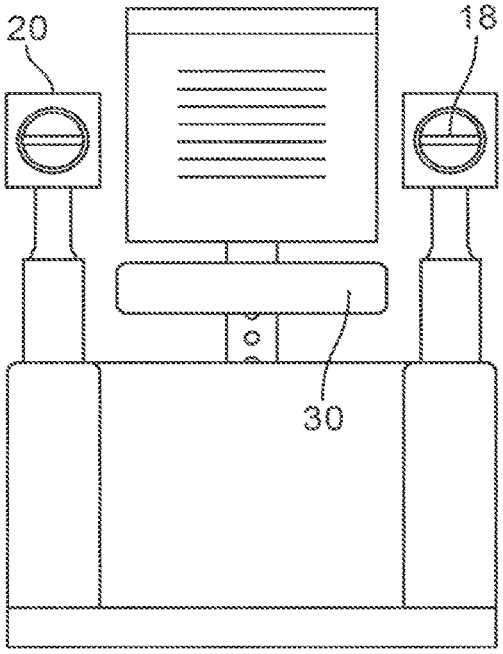
Figure 5B:
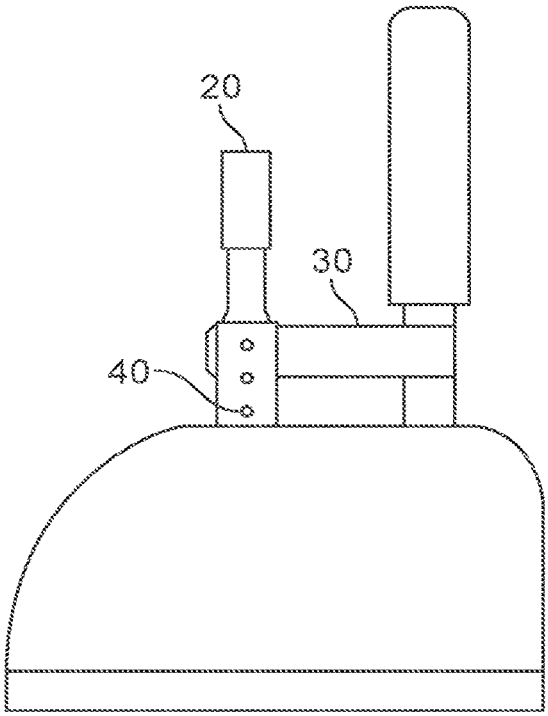

The handles may be orientated as desired to vary the exercise by placing differing loads on different muscles, as shown in FIGS. 3*a* and *b*.

The handle may be moved up and/or down in a reciprocating fashion to act upon push rod 17. The position of the handles relative to the push rod may be adjusted to accommodate differing vertical handle positions relative to the push rod and the wheel accommodating users having differing heights or to focus the exercise on different muscles.

The handles position relative to the housing may be adjusted using a removable locking bolt which cooperates with apertures 40.

The apparatus may simply have a platform in an embodiment between the wheels rather than a seat to permit a wheel chair to be accommodated there between should a wheelchair user wish to operate the apparatus. The wheelchair can then be locked into position. This may prove beneficial to paralympians and other wheel chair users. Alternatively, the apparatus may be used whilst standing.

Figure 6:
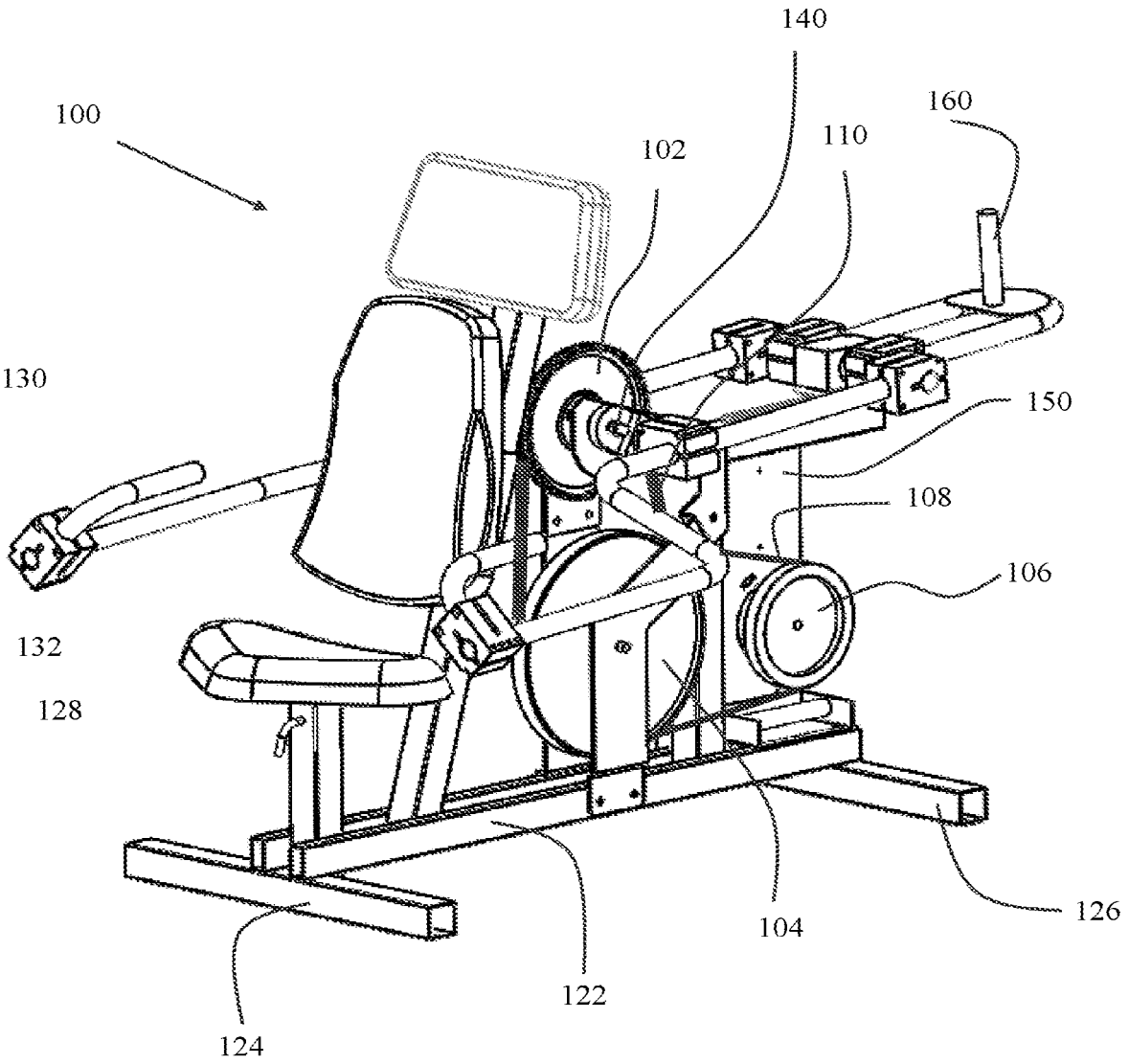
FIG. 6 shows an embodiment in accordance with the present invention.
Figure 7:
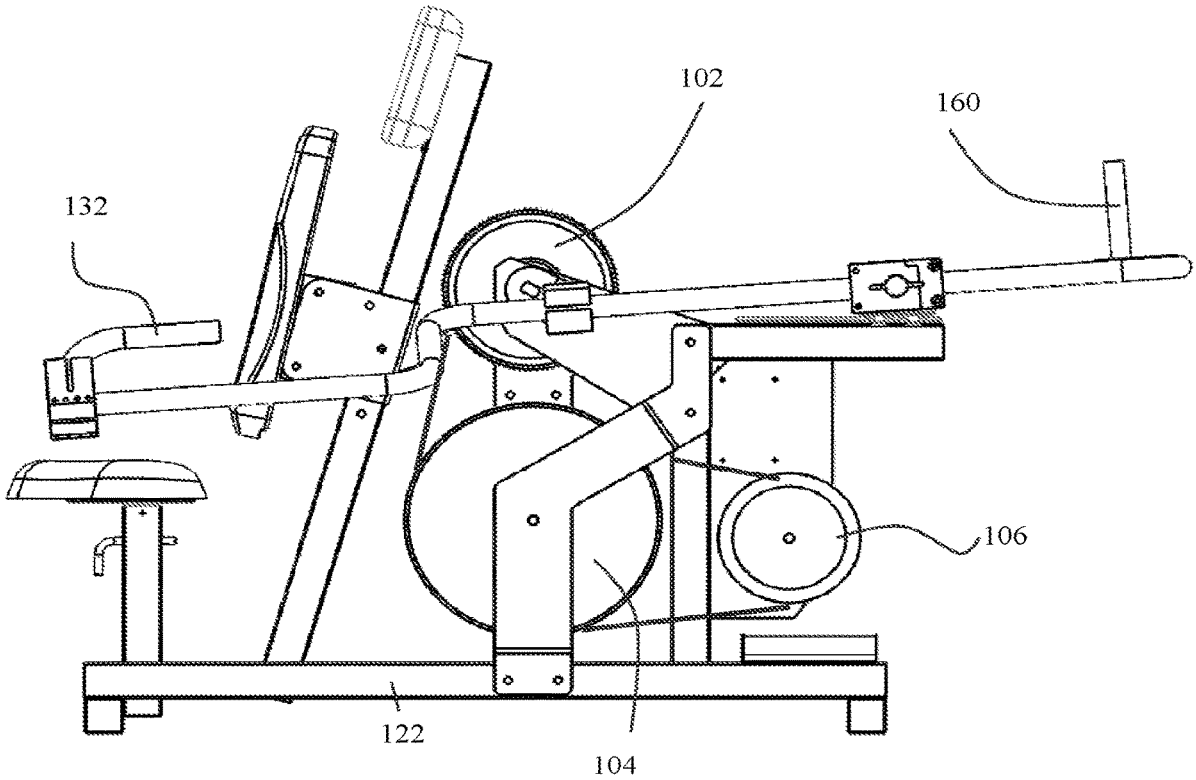
FIG. 7 shows a side elevation of the embodiment shown in FIG. 6.

FIGS. 6 and 7 show an embodiment of the present invention. The exercise apparatus 100 has a pulley system comprising first, second and third wheels 102, 104, 106 operably connected to one another by first and second belts 108, 110.

The pulley system is mounted on a frame 120 having a base 122 and two legs 124, 126 on which is mounted a chair 128, whose position is adjustable.

There are two handles 130, 132 connected to either side of the first wheel 102 by means of rods 140 (only one side shown) which is pivotally mounted to the handles and wheel.

The free ends of the handles extend beyond the seat and have on one handle a brake actuator for slowing and ultimately stopping the rotation of the wheels and the other having a controller which adjusts the resistance to rotate the third wheel which is connected to the drive unit 150 which provides the adjustable resistance to rotation of the wheels.

The facility to add a counterbalance is provided by an upstanding rod 160 distally disposed with respect to the handles. The rod received weights having correspondingly shaped apertures through which the rod may extend. The number of weights mounted on the rod can vary according to the resistance required.

From the foregoing description, it should be appreciated that apparatus and methods for providing introduction for the purpose of enhancing cardiovascular exercise activity is provided and presents significant benefits that would be apparent to one skilled in the art. Furthermore, while multiple embodiments have been presented in the foregoing description, it should be appreciated that a vast number of variations in the embodiments exist. Lastly, it should be appreciated that these embodiments are preferred exemplary embodiments only and are not intended to limit the scope, applicability, or configuration of the invention in any way. Rather, the foregoing detailed description provides those skilled in the art with a convenient road map for implementing a preferred exemplary embodiment of the invention, it being understood that various changes may be made in the function and arrangement of elements described in the exemplary preferred embodiment without departing from the spirit and scope of the invention as set forth in the appended claims.

The invention claimed is:

1. An exercise apparatus comprising at least one wheel, wherein each wheel is respectively and pivotably connected to a first end of a bar, a second end of the bar being respectively and pivotably connected to an actuating member, wherein each actuating member is respectively and pivotably mounted and comprises a handle mounted thereto, respectively, such that movement of the handle is possible while the respective bar is displaced during use, wherein a rotation opposing means is associated with each wheel to provide a variable resistance to rotation of the respective wheel, wherein movement of the respective bar relative to the respective wheel is elliptical, and wherein the exercise apparatus further comprises a seat located a vertical distance above the at least one wheel.

2. The exercise apparatus as claimed in claim 1, wherein each wheel is magnetic and the respective rotation-opposing means comprises at least one magnet.

3. The exercise apparatus as claimed in claim 1, wherein the rotation-opposing means comprises a torsion spring having a resistance that can be varied.

4. The exercise apparatus as claimed in claim 1, wherein the rotation-opposing means comprises webbing which can extend at least partially around a circumference of the respective wheel to provide the variable resistance to the rotation of the respective wheel.

5. The exercise apparatus as claimed in claim 1, wherein the rotation-opposing means comprises one or more blades mountable onto a surface of the respective wheel to resist the rotation by providing resistance against a fluid.

6. The exercise apparatus as claimed in claim 5, wherein the fluid comprises air, liquid, or a combination thereof.

7. The exercise apparatus as claimed in claim 1, wherein the exercise apparatus is a hand-operated elliptical trainer.

8. The exercise apparatus as claimed in claim 1, wherein a vertical height of the seat can be adjusted.

9. The exercise apparatus as claimed in claim 1, wherein the seat is moveably mounted and can be moved in a plane with respect to the exercise apparatus.

10. The exercise apparatus as claimed in claim claim 1, wherein the at least one wheel comprises a first wheel and a second wheel, the at least one bar comprises a first bar and a second bar, the actuating members comprise a first actuating member and second actuating member, and the handles comprise a first handle and a second handle, wherein the first bar is pivotably connected to the first wheel at one end and pivotably connected at another end to the first actuating member, wherein the first actuating member is pivotably mounted and comprises the first handle mounted thereto such that movement of the first handle is possible while the first bar is displaced during use; and wherein the second bar is pivotably connected to the second wheel at one end and pivotably connected at the another end to the second actuating member, wherein the second actuating member is pivotably mounted and comprises the second handle mounted thereto such that movement of the second handle is possible while the second bar is displaced during use; and wherein the rotation-opposing means are respectively associated with first and second wheels to provide the variable resistance to the rotation of the first and second wheels and wherein the movement of the first and second bars relative to the first and second wheels is elliptical.

11. The exercise apparatus as claimed in claim 10 wherein the first and second wheels are spaced apart and respectively mounted on a first base and a second base.

12. The exercise apparatus as claimed in claim 1, wherein the at least one wheel is two wheels, and wherein the seat is disposed between the two wheels.

13. The exercise apparatus as claimed in claim 1 wherein the each handle is rotatably mounted within a housing.

14. The exercise apparatus as claimed in claim 13 wherein each handle has a plurality of grip positions configured for a user to engage with the respective handle.

15. The exercise apparatus as claimed in claim 14 wherein the handles comprise grip elements configured for minimizing slippage and lift-off of hands of the user.

16. The exercise apparatus as claimed in claim 1 wherein each wheel is moveably mounted on a base.

17. The exercise apparatus as claimed in claim 16, wherein each wheel is independently moveable relative to one another.

* * * * *